US006801627B1

(12) United States Patent
Kobayashi

(10) Patent No.: US 6,801,627 B1
(45) Date of Patent: Oct. 5, 2004

(54) METHOD FOR LOCALIZATION OF AN ACOUSTIC IMAGE OUT OF MAN'S HEAD IN HEARING A REPRODUCED SOUND VIA A HEADPHONE

(75) Inventor: Wataru Kobayashi, Tokyo (JP)

(73) Assignees: OpenHeart, Ltd., Tokyo (JP); A Limited Responsibility Company, Research Network, Kyoto (JP)

( * ) Notice: Subject to any disclaimer, the term of this patent is extended or adjusted under 35 U.S.C. 154(b) by 0 days.

(21) Appl. No.: 09/408,102

(22) Filed: Sep. 29, 1999

(30) Foreign Application Priority Data

Sep. 30, 1998 (JP) ..... 10-291348

(51) Int. Cl.[7] ..... H04R 5/00; H04R 5/02

(52) U.S. Cl. ..... 381/17; 381/310; 381/307

(58) Field of Search ..... 381/77, 17, 309, 381/310, 99, 61, 63, 307

(56) References Cited

U.S. PATENT DOCUMENTS 5,742,688 A * 4/1998 Ogawa et al. ..... 381/17
6,091,894 A * 7/2000 Fujita et al. ..... 703/13

* cited by examiner

*Primary Examiner*—Forester W. Isen
*Assistant Examiner*—Elizabeth McChesney
(74) *Attorney, Agent, or Firm*—Duane Morris LLP

(57) ABSTRACT

The disclosure relates to localization of an acoustic image out of the head in hearing a reproduced sound via headphone, and includes the steps of: with audio signals S1–S11 of left, right channels reproduced by an appropriate audio appliances as input signals, branching the input signals of the left and right channels to at least two systems; to form signals of each systems corresponding to the left, right channels with left, right speaker sounds imagined in an appropriate sound space with respect to the head of a listener wearing a headphone Hp and virtual reflected sound in the virtual sound space SS caused from a sound generated from the left and the right virtual speaker $S_{PL}$, $S_{PR}$, creating a virtual speaker sound signal by processing so that the virtual speaker sounds from the left and the right speakers are expressed by direct sound signals, and virtual reflected sound signals by processing so that the virtual reflected sound is expressed by reflected sound signals; mixing the direct sound signal and reflected sound signal of each of the left, right channels created in the above manner with mixers $M_L$, $M_R$ for the left, right ears of the headphone with outputs of the left and right mixers, $M_L$, $M_R$.

20 Claims, 3 Drawing Sheets

METHOD FOR LOCALIZATION OF AN ACOUSTIC IMAGE OUT OF MAN'S HEAD IN HEARING A REPRODUCED SOUND VIA A HEADPHONE

BACKGROUND OF THE INVENTION

1. Field of the Invention

The present invention relates to a method and device for localizing an acoustic image at an arbitrary position when audio signal outputted from an audio appliance is heard via a headphone.

2. Description of the Related Art

Conventionally, various methods for localizing an acoustic image out of the head of a listener when a reproduced sound about music or the like is heard via a headphone have been proposed.

When a reproduced sound of music or the like is heard via a well known headphone, an acoustic image exists in the head of a listener so that audibility of this case is quite different from when a music or the like is heard via speakers placed in an actual sound space driven. Therefore, various technologies and researches for localizing an acoustic image out of the head of the listener when listening via a headphone, so as to obtain a similar audibility to when a sound is reproduced via external speakers have been proposed.

However, up to now proposed methods for localizing an acoustic image out of the head have not succeeded in obtaining sufficiently satisfactory acoustic image out of the head.

SUMMARY OF THE INVENTION

Accordingly, the present invention has been achieved in views of the above-mentioned problem and therefore, it is an object of the invention to provide a method for localizing an acoustic image out of the head upon listening via a headphone capable of obtaining an audibility just as if a reproduced sound is heard at a listening point via actual speakers, different from conventional methods and a device for achieving the same method.

To achieve the above object, according to an aspect of the present invention, there is provided a method for localization of an acoustic image out of the head in hearing a reproduced sound via a headphone, comprising the steps of: with audio signals of left, right channels reproduced by an appropriate audio appliance as input signals, branching the input signals of the left and right channels to at least two systems; to form signals of each system corresponding to the left, right channels with left, right speaker sounds imagined in an appropriate sound space with respect to the head of a listener wearing a headphone and virtual reflected sound in the virtual sound space caused from a sound generated from the left and right virtual speakers, creating a virtual speaker sound signal by processing so that the virtual speaker sounds from the left and right speakers are expressed by direct sound signals, and virtual reflected sound signals by processing so that the virtual reflected sound is expressed by reflected sound signal; mixing the direct sound signal and reflected sound signal of each of the left, right channels created in the above manner with mixers for the left and right channels; and supplying both the speakers for the left, right ears of the headphone with outputs of the left and right mixers.

According to the method of the present invention having such a configuration, each of the sound signals of the left, right virtual speakers and virtual reflected sound is divided to at least two frequency bands. Then, the virtual speaker sounds and virtual reflected sound appealing to man's sense of hearing are formed by processing the divided signal of each band by controlling a feeling of sound direction and a feeling of a distance up to the virtual speaker and reflection sound source. These signals are mixed in the left, right mixers and the left, right mixers are connected to the left, right speakers.

In the present invention, a factor for the feeling of the directions of the virtual speaker and virtual reflection sound source depends on a difference of times of acoustic frequencies entering into the left and right ears of a listener or a difference of volume or differences of time and volume. Further, a factor for the feeling of the distance up to the virtual speakers and virtual reflection sound source depends on a difference of volume of acoustic frequency signals entering into the left and right ears or a difference of time or differences of volume and time.

Therefore, according to another aspect of the present invention there is provided a method for localization of an acoustic image out of the head in hearing a reproduced sound via a headphone by processing audio signals for the left, right speakers of the headphone, comprising the steps of: dividing the audio signal to audio signal for virtual speaker sound and audio signal for virtual reflected sound so as to form left, right virtual speaker sounds and virtual reflected sound of the virtual speaker sound from audio signal reproduced by an appropriate audio appliance; dividing each of the audio signals to low/medium range and high range or low range and medium/high range or low range and medium/high range in terms of frequency band; for the medium range, making a control based on a simulation by head transmission function of frequency characteristic; for the low range, making a control with a time difference or a time difference and a volume difference as parameter; and for the high range, making a control with a volume difference or a volume difference and a time difference by combfilter processing as parameter.

Further, according to still another aspect of the present invention, there is provided a device for localization of an acoustic image out of the head in hearing a reproduced sound via a head phone, comprising: a signal processing portion for left, right virtual speaker sounds for processing the virtual speaker sounds based on a function of transmission up to an entrance of the concha of a headphone user corresponding to the left, right speakers imagined in an any virtual sound space; a signal processing portion for the left, right reflected sounds based on the function of transmission of the virtual reflected sound because of a reflection characteristic set up arbitrarily in the virtual sound space; and left, right mixers for mixing processed signals in the signal processing portion in an arbitrary combination, speakers for the left, right ears of the headphone being driven by an output of the left, right mixers.

DESCRIPTION OF THE PREFERRED EMBODIMENTS

Figure 1:
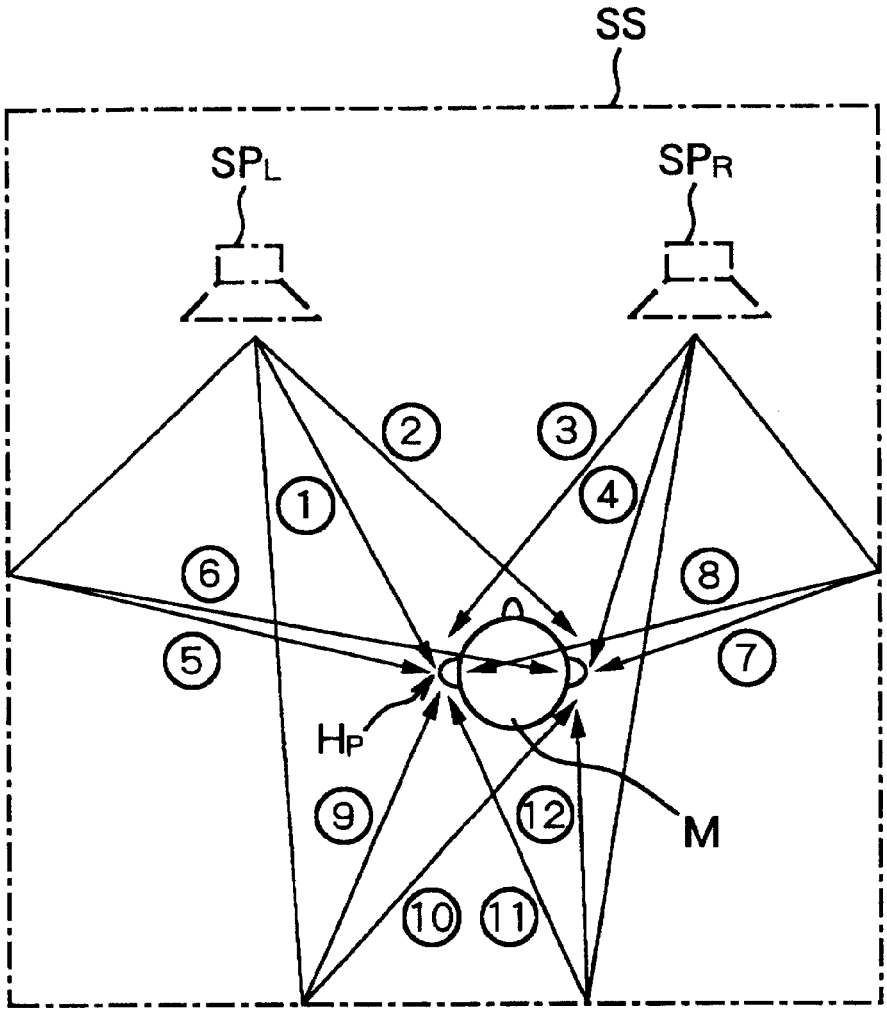
FIG. 1 is a plan view showing a relation of positions between a listener with a headphone, a virtual sound space and virtual speakers according to the present invention.

Hereinafter, the embodiment of the present invention will be described with reference to the accompanying drawings.

According to the present invention, audio signals for left and right channels inputted from an audio appliance are divided to audio signal for left and right virtual speakers and audio signal for virtual reflected sound which is outputted from these speakers and reflected by an appropriate virtual sound space. The divided audio signal for the left and right virtual speakers and virtual reflected sound of the virtual speaker sound in the virtual audio space are divided each to, for example, three bands, low, medium and high frequencies. A processing for controlling an acoustic image localizing element is carried out on each audio signal. In this processing, to imagine actual speakers in an arbitrary audio space, it is assumed that left and right speakers are placed forward of a virtual audio space and a listener wearing a headphone is seated in front of those speakers. An object of the processing is to process audio signals reproduced by an audio appliance so that direct sounds transmitted from the actual speakers to the listener and reflected sounds of the speaker sounds reflected in this audio space become sounds heard when these sounds actually enter both the ears of the listener wearing with the headphone. According to the present invention, the division of the audio signals to bands is not restricted to the above example, but may be divided to medium/low band and high band, low band and medium/high band, low band and high band, or these bands may be further divided so as to obtain two or four or more bands.

Conventionally, it has been known that when man hears a sound from an actual sound source with both the ears, such physical factors as his head, both the ears on the left and right sides of the head and a sound transmitting structure of both the ears affect localization of acoustic image. Then, the present invention aims to achieve, when a reproduced sound from the headphone speakers is heard with both the ears, a processing for enabling to control localization of an acoustic image at any place out of the head with audio signals inputted to the headphone.

First, if the head of a person is regarded as a sphere having a diameter of about 150–200 mm although there is a personal difference therein, in frequencies (hereinafter referred to as aHz) below a frequency whose half wave length is this diameter, that half wave length exceeds the diameter of the above spheres and therefore, it is estimated that a sound of a frequency below the above aHz is hardly affected by the head portion of a person. Therefore, the aforementioned inputted audio signals are processed so that a sound from the virtual speakers below the aHz and reflected sound in the audio space become sounds which enter into both the ears of the person. That is, in sounds below the above aHz, reflection and diffraction of sound by the person's head are substantially neglected. Then, a difference of time and a difference of volume between a sound from the virtual speaker as a virtual sound source and its reflected sound when they enter into both the ears are controlled as parameters of the direct sound and reflected sound, so as to localize an acoustic image in this band at any place out of the head of a listener wearing the headphone.

On the other hand, if the concha is regarded as substantially a cone and the diameter of its bottom face is assumed to be substantially 35–55 mm, it is estimated that a sound having a frequency larger than a frequency (hereinafter referred to as bHz) whose half wave length exceeds the diameter of the aforementioned concha is hardly affected by the concha as a physical element. Based thereon, the inputted audio signals of the virtual speaker sound and virtual reflected sound below the aforementioned bHz are processed. An inventor of the present invention measured acoustic characteristic in a frequency band more than the aforementioned bHz using a dummy head. As a result, it was confirmed that that characteristic resembled the acoustic characteristic of a sound passed through a combfilter.

From these matters, it has been known that the acoustic characteristics of different elements have to be considered. As for localization of sound image about a frequency band higher than the aforementioned bHz, it has been concluded that the inputted audio signal in the headphone speaker of this band can be localized at any place out of the head by filtering the audio signals of the virtual speaker sound and virtual reflected sound of this band with the combfilter and then controlling these sounds with a difference of time and a difference of volume between these sounds when they enter into both the ears as parameters.

About a narrow band from aHz to bHz left in others than the above considered bands, it has been confirmed that the virtual speaker sound and virtual reflected sound can be produced by simulating the frequency characteristic by reflection and diffraction caused by the head portion and concha as physical elements and then controlling the inputted audio signals. Based on this knowledge, the present invention has been achieved.

According to the above knowledge, a test about localization of an acoustic image out of the head when hearing with both the ears through the headphone speakers was made about virtual speaker sounds (direct sound) and virtual reflected sound in a virtual audio space of this speaker sound, in each band of below aHz, higher than bHz, and between aHz and bHz in frequency, with a difference of time and a difference of volume between sounds entering into the left and right ears as parameters for control factor. Consequently, a following result was obtained.

Result of a Test in a Band Below aHz

Although about the audio signals of virtual direct sound and virtual reflected sound in this band, some extent of localization of sound image out of the head is enabled only by controlling two parameters, namely, a difference of time of sounds entering into the left and right ears and a difference of sound volume, a localization in any space including vertical direction cannot be achieved sufficiently by controlling these elements alone. By controlling the difference of time between the left and right ears in the unit of 1/10 to 5 seconds and the sound volume in the unit of ndB (n is a natural number of one or two digits), it was made evident that a position for localization of a sound image in terms of horizontal plane, vertical plane and distance can be achieved arbitrarily. Meanwhile, if the difference of time between the left and right ears is further increased, the position for localization of a sound image is placed in the back of a listener. Therefore, the control of this parameter is useful for controlling the localization of the virtual reflected sound out of the head in the back of the listener.

Result of a Test in a Band Between aHz and bHz

Influence of Time Difference

With a parametric equalizer (hereinafter referred to as PEQ) made invalid, a control for providing sounds entering into the left and right ears with a difference of time was carried out. As a result, no localization of a sound image was obtained unlike a control in a band below the aforementioned aHz. Meanwhile, it is considered that control by only time difference in this band is useful for localization of the virtual reflected sound out of the head in the left and right of the listener, because an acoustic image in this band is moved linearly in the left-right direction.

In case of processing the inputted audio signals through the PEQ, a control with the difference of time of sounds entering into the left and right ears as a parameter is important. Here, the acoustic characteristics which can be corrected by the PEQ are three kinds including fc (central frequency), Q (sharpness) and gain. Thus, by selecting or combining the acoustic characteristics correctable with the PEQ depending on whether a signal to be controlled is virtual direct sound or virtual reflected sound, a further effective control is enabled.

Influence of Difference of Sound Volume

If the difference of sound volume with respect to the left and right ears is controlled around the ndB (n is a natural number of one digit), a distance for localization of a sound image is extended. As the difference of sound volume increases, the distance for localization of the sound image shortens.

Influence of fc

When a sound source is placed at an angle of 45 degrees forward of a listener and an audio signal entering from that sound source is subjected to PEQ processing according to the listener's head transmission function, it has been known that if the fc of this band is shifted to a higher side, the distance for sound image localizing position tends to be prolonged. Conversely, it has been known that if the fc is shifted to a lower side, the distance for the sound image localizing position tends to be shortened.

Influence of Q

When the audio signal of this band was subjected to the PEQ processing under the same condition as in case of the aforementioned fc, if Q near 1 kHz of the audio signal for the right ear was increased up to about four times relative to its original value, the horizontal angle was decreased but the distance was increased while the vertical angle was not changed. As a result, it is possible to localize an acoustic image forward in a range of about 1 m in a band from aHz to bHz.

When the PEQ gain is minus, if the Q to be corrected is increased, the acoustic image is expanded and the distance is shortened.

Influence of Gain

When the PEQ processing is carried out under the same condition as in the above influences of fc and Q, if the gain at a peak portion near 1 kHz of the audio signal for the right ear is lowered by several dB, the horizontal angle becomes smaller than 45 degrees while the distance is increased. As a result, almost the same acoustic image localization position as when the Q was increased in the above example was realized. Meanwhile, if a processing for obtaining the effects of Q and gain at the same time is carried out by the PEQ, there is no change in the distance for the acoustic image localization produced.

Result of a Test in a Band Above bHz

Influence of Time Difference

By only a control based on the time difference of sound entering into the left and right ears, localization of acoustic image could be hardly achieved in this band. However, a control for providing with a time difference to the left and right ears after the combfilter processing was carried out was effective for the localization of the acoustic image.

Influence of Sound Volume

It has been known that if the audio signal of this band is provided with a difference of sound volume with respect to the left and right ears, that influence was very effective as compared to the other bands. That is, for a sound in this band to be localized in terms of acoustic image, a control capable of providing the left and right ears with some extent of the difference of sound volume, for example, more than 10 dB is necessary.

Influence of Combfilter Gap

As a result of making tests by changing a gap of the combfilter, the position for localization of the sound image was changed noticeably. Further, when the gap of the combfilter was changed about a single channel for the right ear or left ear, the acoustic image at the left and right sides was separated in this case and it was difficult to sense the localization of the acoustic image. Therefore, the gap of the combfilter has to be changed at the same time for both the channels for the left and right ears.

Influence of the Depth of the Combfilter

A relation between the depth and vertical angle has a characteristic which is inverse between the left and right.

A relation between the depth and horizontal angle also has a characteristic which is inverse between the left and right.

It has been known that the depth is proportional to the distance for localization of a sound volume.

Result of a Test in Crossover Band

There was no discontinuity or feeling about antiphase in a band below aHz, an intermediate range of aHz–bHz and a crossover portion between this intermediate band and a band above bHz. Then, a frequency characteristic in which the three bands are mixed is almost flat.

As a result of the above test, it has been testified that to localize an acoustic image out of the head with sounds from both the left and right speakers produced from speakers, the virtual direct sound from virtual speakers and reflected sound of the speaker sound in a virtual sound space are divided into a plurality of frequency bands for each of the left and right ears and signals of each band are controlled by a different factor.

That is, one of facts testified from the above test is that an influence on localization of the acoustic image by a time difference of sounds entering into the left and right ears is conceivable in a band below aHz and the influence by the time difference is weak in a band over bHz.

Additionally, it has been made evident that use of the combfilter and providing the left and right ears with a difference of volume are meaningful for localization of the acoustic image. Further, in an intermediate band from aHz to bHz, other parameter than the above control factor for localizing forward although the distance is short has been found.

Figure 2:
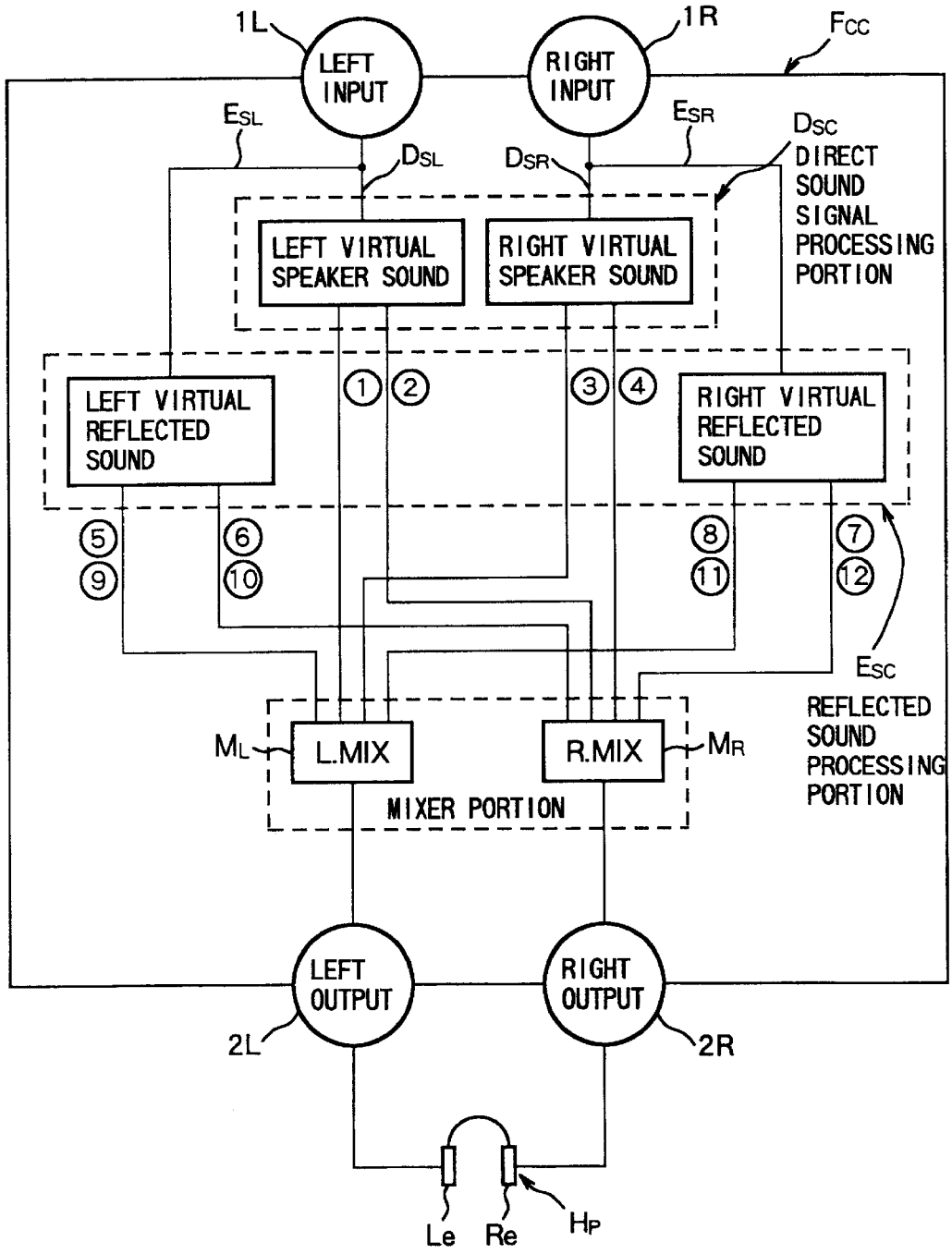
FIG. 2 is a block diagram showing an example of a signal processing system for carrying out the present invention.
Figure 3:
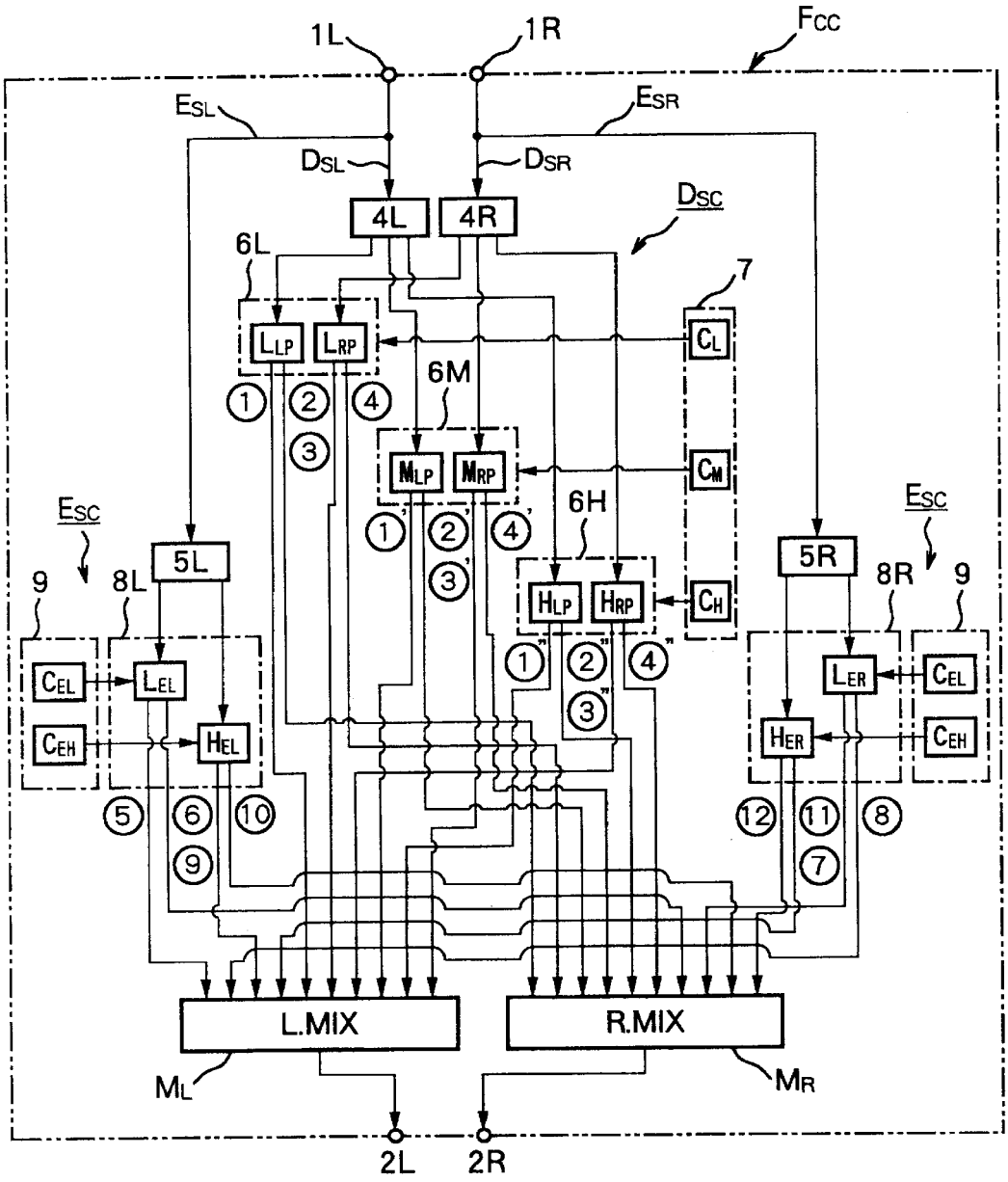
FIG. 3 is a functional block diagram in which the block diagram of FIG. 2 is expressed precisely.

Next, an example of carrying out the method of the present invention will be described. FIG. 1 is a plan view showing a relation of position between a listener wearing a headphone, virtual sound space and virtual speakers according to the present invention. FIG. 2 is a block diagram showing an example of signal processing system for which the method of the present invention is carried out. FIG. 3 is a functional block diagram in which the block diagram of FIG. 2 is expressed more in detail.

FIG. 1 expresses a concept of a sound space for localization of an acoustic image which a listener wearing a headphone is made to feel according to the present invention. In this Figure, SS indicates a virtual sound space, $SP_L$, indicates a left channel virtual speaker and $SP_R$, indicates a right channel virtual speaker. According to the method of the present invention, the listener M wearing the headphone Hp can feel just as if he actually hears reproduced sounds from the left and right virtual speakers $S_L$, $S_R$, in this sound space SS which he feels actually exist, with his left and right ears, for example via a sound (direct sound) which enters into both the ears directly S1–S4 (indicated with numerals surrounded by a circle) and a sound which is reflected by a side wall or rear wall in the space SS and enters into both the ears (reflected sounds S5–S11, indicated with numerals surrounded by a circle in FIG. 1). The present invention is constructed with a structure exemplified in FIGS. 2, 3 as an example for the listener wearing the headphone Hp to be capable of obtaining a feeling that an acoustic image is placed out of his head as shown in FIG. 1. This point will be described in detail with reference to FIG. 2.

Referring to FIG. 2, reproduced audio signals from an audio appliance to be inputted to left and right input terminals 1L, 1R of a signal processing circuit Fcc are branched to signals for two systems for each of left and right channels, $D_{SL}$, $E_{SL}$, $D_{SR}$, $E_{SR}$. The audio signals $D_{SL}$, $E_{SL}$, $D_{SR}$, $E_{SR}$ divided to two systems of the respective channels are supplied to left, right direct sound signal processing portion $D_{SC}$ for forming direct sounds S1–S4 from the left and right virtual speakers and reflected sound signal processing portion $E_{SC}$ for forming reflected sounds S5–S11. In each of the signal processing portions $D_{SC}$, $E_{SC}$, the method according to the present invention is carried out for each of the left and right channel signals.

Of the audio signals S1–S4, S5–S12 subjected to signal processing of the method of the present invention in the processing portions $D_{SC}$, $E_{SC}$ for each of the left and right channels, as shown in FIG. 2, direct sound signals S1, S3 and reflected sound signals S5, S9, S8, S11 are supplied to a mixer ML of the left channel and then direct sound signals S2, S4 and reflected sound signals S6, S10, S7, S12 are supplied to a mixer $M_R$, of the right channel, and the signals are mixed in each of the mixers. outputs of the mixers $M_L$, $M_R$ are connected to output terminals 2L, 2R of this processing circuit Fcc.

More specifically, the signal processing circuit Fcc shown in FIG. 2 according to the method of the present invention can be formed as shown in FIG. 3. This form will be described. In FIG. 3 also, the direct sound signals S1–S4 and reflected sound signals S5–S12 are indicated with numerals surrounded by a circle (including dashed numerals).

Referring to FIG. 3, the signal processing circuit Fcc of the present invention having a following structure is disposed between input terminals 1L, 1R for inputting audio signals for left and right channels outputted from any audio playback unit and output terminals 2L, 2R for the left and right channels to which input terminals of the headphone Hp is to be connected.

In FIG. 3, 4L, 4R denote band dividing filters for direct sounds for the left, right channels connected in rear of 1L, 1R and 5L, 5R denote band dividing filters for reflected sound provided with the same condition. These filters divide inputted audio signals to, for example, low band of below about 1000 Hz, medium band from about 1000 to about 4000 Hz and high band of above about 4000 Hz for each of the left, right channels. According to the present invention, the number of divisions of a band of a reproduced audio signal to be inputted through the input terminals 1L, 1R is arbitrary if it is 2 or more.

6L, 6M, 6H denote signal processing portion for processing audio signals of each band for the direct sounds of the left and right channels, divided by the left, right filters 4L, 4R. Here, a low range signal processing portion $L_{LP}$, $L_{RP}$, medium range signal processing portion $M_{LP}$, $M_{RP}$, and high range signal processing portion $H_{LP}$, $H_{RP}$ are formed for each of the left and right channels.

Reference numeral 7 denotes a control portion for providing the audio signals of the left and right channels in each band processed by the aforementioned signal processing portions 6L–6H with a control for localization of sound image out of the head. In the example shown here, by using three control portions $C_L$, $C_M$ and $C_H$, for each band, a control processing with a time difference and a volume difference with respect to the left and right ears described previously as parameter is applied to signals for the left and right channels in each band. In the above example, it is assumed that at least the control portion $C_H$, of the signal processing portion 6H for the high range is provided with a function for giving a coefficient for making this processing portion 6H act as the combfilter.

8L, 8R denote a signal processing portion for each band (although two bands, medium/low bands and high band, are provided here, of course, two or more bands are permitted) of the reflected sound divided by the filters 5L, 5R and for each of the left and right channels, medium/low range processing portions $L_{EL}$, $L_{ER}$ and high range processing portions $H_{EL}$, $H_{ER}$ are formed. Reference numeral 9 denotes a control portion for providing a control for localization of an acoustic image to the reflected sound signals of two bands to be processed by the aforementioned signal processing portions 8L, 8R. Here, by using control portions $C_{EL}$, $C_{EH}$ for the band of two virtual reflected sounds, a control processing with a time difference and a volume difference with respect to sounds reaching the left and right ears is carried out.

The controlled virtual direct sound signal and reflected sound signal outputted from the signal processing portions Dsc (6L, 6M, 6H) and Esc (8L, 8R) for the direct sound and reflected sound pass through a crossover filter for each of the left and right channels and then are synthesized by the mixers $M_L$, $M_R$. If input terminals of the headphone Hp are connected to the output terminals 2L, 2R connected to these mixers $M_L$, $M_R$, sound heard via the left, right speakers of the headphone Hp is reproduced as clear playback sound whose acoustic image is localized out of the head.

The method of the present invention has been described above. In a conventional method for localization of an acoustic image out of the head via a headphone, reproduction signals are controlled using the head transmission function to localize an acoustic image out of the head when audio signal reproduced by an appropriate audio appliance is heard by stereo via left and right ear speakers of the headphone. According to the present invention, before the audio signals reproduced by the audio appliance are inputted to the headphone, those audio signals are divided to virtual direct sound signal and virtual reflected sound signal. Further, the respective divided signals are divided to three bands, low, medium and high, and a processing for controlling each band with such an acoustic image localizing element such as a time difference and a volume difference as parameter is carried out so as to form audio signals for the left and right ear speakers of the headphone. As a result, a reproduced sound ensuring an acoustic image localized clearly out of the head can be obtained upon hearing via the headphone.

What is claimed is:

1. A method for localization of an acoustic image out of the head in hearing a reproduced sound via a headphone, comprising the steps of:

with audio signal of left, right channels reproduced by an appropriate audio appliance as input signals, branching the input signals of the left and right channels to at least two systems;

to form signal of each system corresponding to the left, right channels with left, right speaker sounds imagined in an appropriate sound space with respect to the head of a listener wearing a headphone and virtual reflected sound in the virtual sound space caused from a sound generated from the left and right virtual speakers, creating a virtual speaker sound signal by processing so that the virtual speaker sounds from the left and right speakers are expressed by direct sound signals, and virtual reflected sound signals by processing so that the virtual reflected sound is expressed by reflected sound signal;

mixing together the direct sound signal and reflected sound signal of each of the left, right channels created in the above manner with mixers for the left and right channels; and supplying both the speakers for the left, right ears of the headphone with outputs of the left and right mixers.

2. A method for localization of an acoustic image out of the head in hearing a reproduced sound via a headphone by processing audio signals for the left, right speakers of the headphone, comprising the steps of:

dividing the audio signal to audio signal for virtual speaker sound and audio signal for virtual reflected sound so as to form left, right virtual speaker sounds and virtual reflected sound of the virtual speaker sound from an audio signal reproduced by an appropriate audio appliance;

dividing each of the audio signals to low/medium range and high range or low range and medium/high range or low range and medium/high range in terms of frequency band;

for the medium range, making a control based on a simulation by head transmission function of a frequency characteristic;

for the low range, making a control with a time difference or a time difference and a volume difference as a parameter; and for the high range, making a control with a volume difference or a volume difference and a time difference by combfilter processing as a parameter.

3. A device for localization of an acoustic image out of the head in hearing a reproduced sound via a headphone, comprising:

a signal processing portion for left, right virtual speaker sounds for processing the virtual speaker sounds based on a function of transmission up to an entrance of the concha of a headphone user corresponding to the left, right speakers imagined in an any virtual sound space;

a signal processing portion for the left, right reflected sounds based on the function of transmission of the virtual reflected sound because of a reflection characteristic set up arbitrarily in the virtual sound space; and left, right mixers for mixing together the direct sound signal and reflected sound signal of each of the left and right channels in the signal processing portion in an arbitrary combination, speakers for the left, right ears of the headphone being driven by an output of the left, right mixers.

4. A method of localizing an external acoustic image through a reproduction of audio signals provided to a headphone comprising the steps of:

(a) providing an input left audio signal and an input right audio signal;

(b) dividing each of the left and right input audio signals into direct signals and reflected signals;

(c) classifying the direct signals and reflected signals as a function of the frequency of the signals, wherein the classifying includes:

(i) identifying a first frequency band as a function of the average diameter of a head;

(ii) identifying a second frequency band as a function of the average diameter of the bottom conical face of a concha; and (iii) classifying the signals as a function of the identified frequency bands;

(d) processing the direct signals and reflected signals as a function of the classification of the signals; and (e) providing the processed signals to the headphone.

5. The method of claim 4 wherein the step of processing further includes the step of:

(iv) controlling the time that the direct and reflected signals are provided to the headphone as a function of the classification of the signals.

6. The method of claim 4 wherein the step of processing further includes the step of:

(v) controlling the volume of the direct and reflected signals provided to the headphone as a function of the classification of the signals.

7. The method of claim 4 wherein the step of mixing includes:

(i) mixing the processed direct signal and reflected signal for the left input signal with the processed direct signal and reflected signal for the right input signal in a left mixer; and (ii) mixing the processed direct signal and reflected signal for the left input signal with the processed direct signal and reflected signal for the right input signal in a right mixer.

8. A method of localizing an external acoustic image through a reproduction of audio signals provided to a headphone comprising the steps of:

(a) providing an input left audio signal and an input right audio signal;

(b) dividing each of the left and right input audio signals into direct signals and reflected signals;

(c) classifying the direct signals and reflected signals as a function of the frequency of the signals; wherein said classifying includes:

(d) processing the direct signals and reflected signals as a function of the classification of the signals, wherein the processing includes mixing together the direct signals and reflected signals to produce a left output signal and a right output signal; and (e) providing the processed signals to the headphone.

9. The method of claim 8 wherein the step of mixing includes:

(i) mixing the processed direct signal and reflected signal for the left input signal with the processed direct signal and reflected signal for the right input signal in a left mixer; and (ii) mixing the processed direct signal and reflected signal for the left input signal with the processed direct signal and reflected signal for the right input signal in a right mixer.

10. The method of claim 8 wherein the step of classifying further includes:

(i) identifying a first frequency band as a function of the average diameter of a head;

(ii) identifying a second frequency band as a function of the average diameter of the bottom conical face of a concha; and (iii) classifying the signals as a function of the identified frequency bands.

11. The method of claim 8 wherein the step of processing further includes the step of:

(f) controlling the time that the direct and reflected signals are provided to the headphone as a function of the classification of the signals.

12. The method of claim 8 wherein the step of processing further includes the step of:

(g) controlling the volume of the direct and reflected signals provided to the headphone as a function of the classification of the signals.

13. A method of localizing an external acoustic image through a reproduction of audio signals provided to a headphone comprising the steps of:

(a) providing an input left audio signal and an input right audio signal;

(b) dividing each of the left and right input audio signals into direct signals and reflected signals;

(c) classifying the direct signals and reflected signals as a function of the frequency of the signals; wherein said classifying includes:

(d) processing the direct signals and reflected signals as a function of the classification of the signals, wherein the processing includes controlling the time that the direct and reflected signals are provided to the headphone as a function of the classification of the signals; and (e) providing the processed signals to the headphone.

14. The method of claim 13 wherein the step of classifying further includes:

(i) identifying a first frequency band as a function of the average diameter of a head;

(ii) identifying a second frequency band as a function of the average diameter of the bottom conical face of a concha; and (iii) classifying the signals as a function of the identified frequency bands.

15. The method of claim 13 wherein the step of processing further includes the step of:

(f) controlling the time that the direct and reflected signals are provided to the headphone as a function of the classification of the signals.

16. The method of claim 13 wherein the step of processing further includes the step of:

(g) controlling the volume of the direct and reflected signals provided to the headphone as a function of the classification of the signals.

17. A method of localizing an external acoustic image through a reproduction of audio signals provided to a headphone comprising the steps of:

(a) providing an input left audio signal and an input right audio signal;

(b) dividing each of the left and right input audio signals into direct signals and reflected signals;

(c) classifying the direct signals and reflected signals as a function of the frequency of the signals; wherein said classifying includes:

(d) processing the direct signals and reflected signals as a function of the classification of the signals, wherein the processing includes controlling the volume of the direct and reflected signals provided to the headphone as a function of the classification of the signals; and (e) providing the processed signals to the headphone.

18. The method of claim 17 wherein the step of classifying further includes:

(i) identifying a first frequency band as a function of the average diameter of a head;

(ii) identifying a second frequency band as a function of the average diameter of the bottom conical face of a concha; and (iii) classifying the signals as a function of the identified frequency bands.

19. The method of claim 17 wherein the step of processing further includes the step of:

(f) controlling the time that the direct and reflected signals are provided to the headphone as a function of the classification of the signals.

20. The method of claim 17 wherein the step of processing further includes the step of:

(g) controlling the volume of the direct and reflected signals provided to the headphone as a function of the classification of the signals.

* * * * *